US011613092B2

(12) United States Patent
Ponti

(10) Patent No.: US 11,613,092 B2
(45) Date of Patent: Mar. 28, 2023

(54) APPARATUS FOR REALISING A CARDBOARD STRIP FOR PACKAGING BY CONSECUTIVELY JOINING A PLURALITY OF CARDBOARD SHEETS FOR PACKAGING TO ONE ANOTHER

(71) Applicant: TECNOBREVETTI S.n.c. di Ponti Giuseppe e Biancono Mirella, Rome (IT)

(72) Inventor: Giuseppe Ponti, Citta' di Castello (IT)

(73) Assignee: C.M.C. S.P.A., Cerbara-Citta' di (IT)

( * ) Notice: Subject to any disclaimer, the term of this patent is extended or adjusted under 35 U.S.C. 154(b) by 0 days.

(21) Appl. No.: 17/286,256

(22) PCT Filed: Oct. 14, 2019

(86) PCT No.: PCT/IB2019/058723
§ 371 (c)(1),
(2) Date: Apr. 16, 2021

(87) PCT Pub. No.: WO2020/079557
PCT Pub. Date: Apr. 23, 2020

(65) Prior Publication Data

US 2021/0347139 A1 Nov. 11, 2021

(30) Foreign Application Priority Data

Oct. 19, 2018 (IT) ..... 102018000009606

(51) Int. Cl.
*B31B 50/06* (2017.01)
*B31B 50/07* (2017.01)
(Continued)

(52) U.S. Cl.
CPC ..... *B31B 50/066* (2017.08); *B31B 50/042* (2017.08); *B31B 50/07* (2017.08);
(Continued)

(58) Field of Classification Search
CPC ..... B31B 50/066; B31B 50/07; B31B 50/624; B31B 50/024; B31B 2105/00; B65H 37/04; B65H 2701/176; B65H 2701/1944
(Continued)

(56) References Cited

U.S. PATENT DOCUMENTS

| | | | | |
|---|---|---|---|---|
| 6,019,153 | A * | 2/2000 | Knokey | B27M 1/02 156/583.1 |
| 2019/0128297 | A1* | 5/2019 | Lamark | F16B 39/282 |
| 2022/0111611 | A1* | 4/2022 | Walsh | B31B 50/36 |

FOREIGN PATENT DOCUMENTS

| | | | |
|---|---|---|---|
| FR | 1434633 | A | 4/1966 |
| WO | WO 2015/173744 | A1 | 11/2015 |
| WO | WO 2018/073770 | A1 | 4/2018 |

* cited by examiner

*Primary Examiner* — Sameh Tawfik
(74) *Attorney, Agent, or Firm* — R. Neil Sudol; Henry D. Coleman

(57) ABSTRACT

Apparatus for making a cardboard strip for packaging includes a store for a stack of cardboard sheets, a gripping mechanism for picking up a sheet from the stack and positioning another sheet on a first support for the application of adhesive, and a transfer mechanism for transferring the first sheet to rest on the second support with an end portion having the adhesive projecting towards the store and towards a third support. The third support is disposable in a raised position to raise an end portion of a second sheet coming from the store and in a lowered position to lower the end portion of the second sheet and position it at the end portion of the first sheet. A pressor presses the two superposed end portions of the two sheets to fix the end portions to one another to form a cardboard strip.

15 Claims, 14 Drawing Sheets

(51) Int. Cl.

| | |
|---|---|
| ***B31B 50/62*** | (2017.01) |
| ***B31B 50/04*** | (2017.01) |
| ***B65H 37/04*** | (2006.01) |
| *B31B 105/00* | (2017.01) |

(52) U.S. Cl.
CPC ..... *B31B 50/624* (2017.08); *B65H 37/04* (2013.01); *B31B 2105/00* (2017.08); *B65H 2701/176* (2013.01); *B65H 2701/1944* (2013.01)

(58) Field of Classification Search
USPC ..... 493/110
See application file for complete search history.

APPARATUS FOR REALISING A CARDBOARD STRIP FOR PACKAGING BY CONSECUTIVELY JOINING A PLURALITY OF CARDBOARD SHEETS FOR PACKAGING TO ONE ANOTHER

FIELD OF THE INVENTION

The present invention relates to the technical sector concerning the packaging of articles by enveloping them with cardboard for packaging.

DESCRIPTION OF THE PRIOR ART

In particular, the invention relates to an apparatus for realising a cardboard strip for packaging by consecutively joining a plurality of cardboard sheets for packaging to one another.

Machines are known for packaging articles, which use a cardboard strip for carrying out the packaging operations of the articles.

For example, EP 2 890 554 describes a machine of this type.

The cardboard strip is wound and stocked in reels or in fan-folds, i.e. in stores in which the cardboard strip is folded on itself and in a bellows-fashion.

The cardboard strip is unwound from the reel or extracted from the fan-fold, then to be cut on the basis of the dimensions of the article, or group of articles, which has to be wound and packaged.

However, the time-by-time supply of the cardboard strips stocked in reels, or in fan-folds, for the operation of the packaging machines, is particularly expensive, and thus, for the users of these packaging machines, this aspect undoubtedly constitutes a drawback.

SUMMARY OF THE INVENTION

The aim of the present invention consists in obviating the above-mentioned drawback.

In particular, an aim of the present invention is to provide an apparatus for realising a cardboard strip for packaging by consecutively joining a plurality of cardboard sheets for packaging to one another, and which can therefore be used in association with a packaging machine, such as to allow for a reduction of costs, as the provision of single cardboard sheets is undoubtedly less expensive than the costs for an already-stocked strip in a reel or a fan-fold.

The above aims are attained by an apparatus for realising a cardboard strip for packaging from a plurality of cardboard sheets for packaging, according to claim 1.

Further characteristics and advantageous aspects of the apparatus of the invention are set down in the various dependent claims.

BRIEF DESCRIPTION OF THE DRAWINGS

A preferred embodiment of the apparatus of the invention is described in the following with reference to the appended tables of drawings, in which.

DESCRIPTION OF THE PREFERRED EMBODIMENTS

Figure 1:
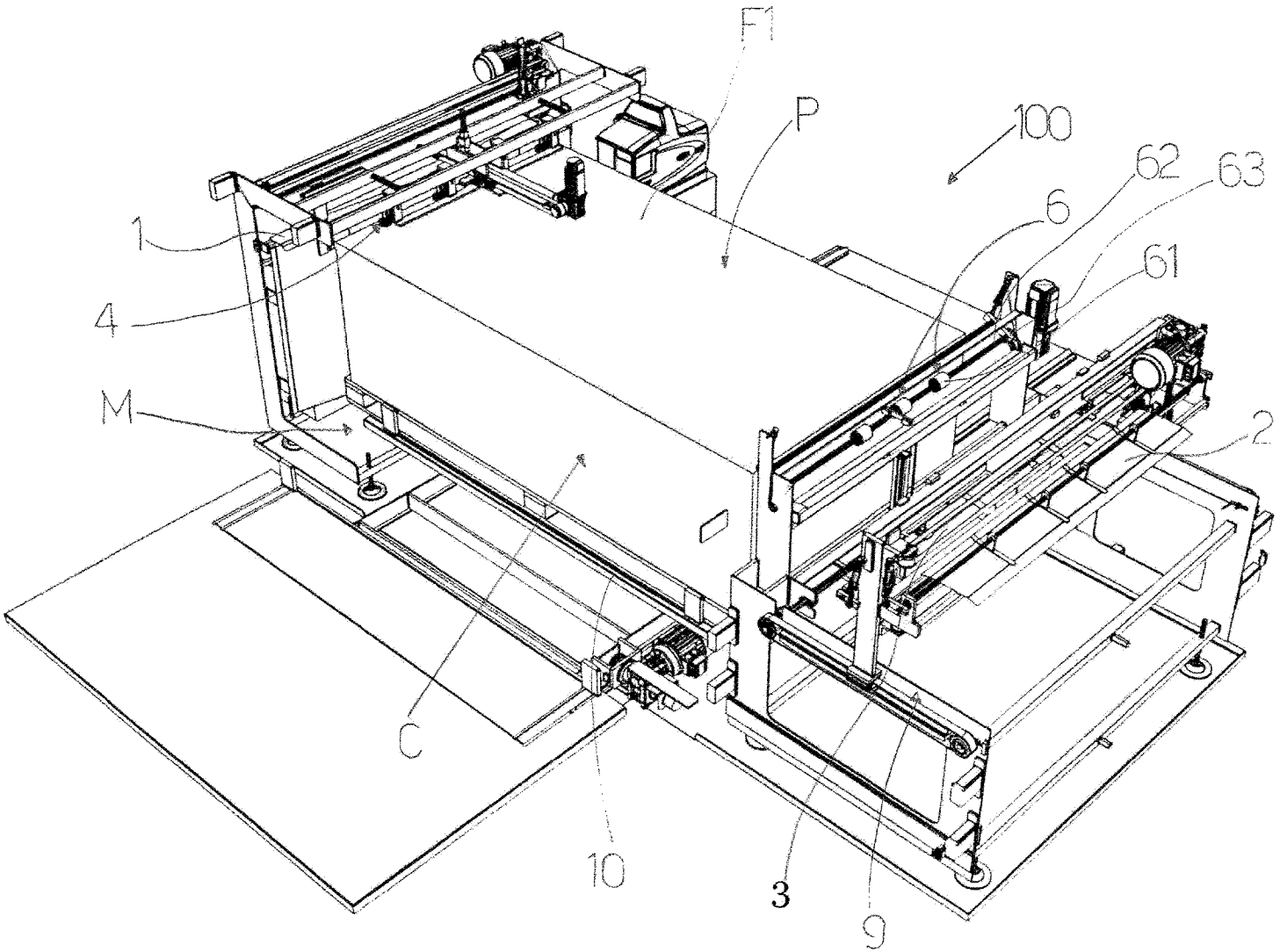
FIG. 1 is a perspective view of the apparatus of the present invention, in which some parts have been omitted to better evidence others.

With reference to the appended tables of drawings, reference numeral (100) denotes the apparatus (100) for realising a cardboard strip for packaging by consecutively joining a plurality of cardboard sheets for packaging, object of the present invention, in its entirety.

As indicated in the foregoing, the apparatus of the invention makes a cardboard strip available, obtained by consecutively joining a plurality of cardboard sheets, to a packaging machine for packaging an article, or a group of articles.

The packaging machine, not being an object of the invention, is not illustrated in the various figures, but reference will be made thereto only as regards the presence of a pulling device, included in the packaging machine, for pulling the cardboard strip which is formed by the apparatus of the invention.

Figure 2A:
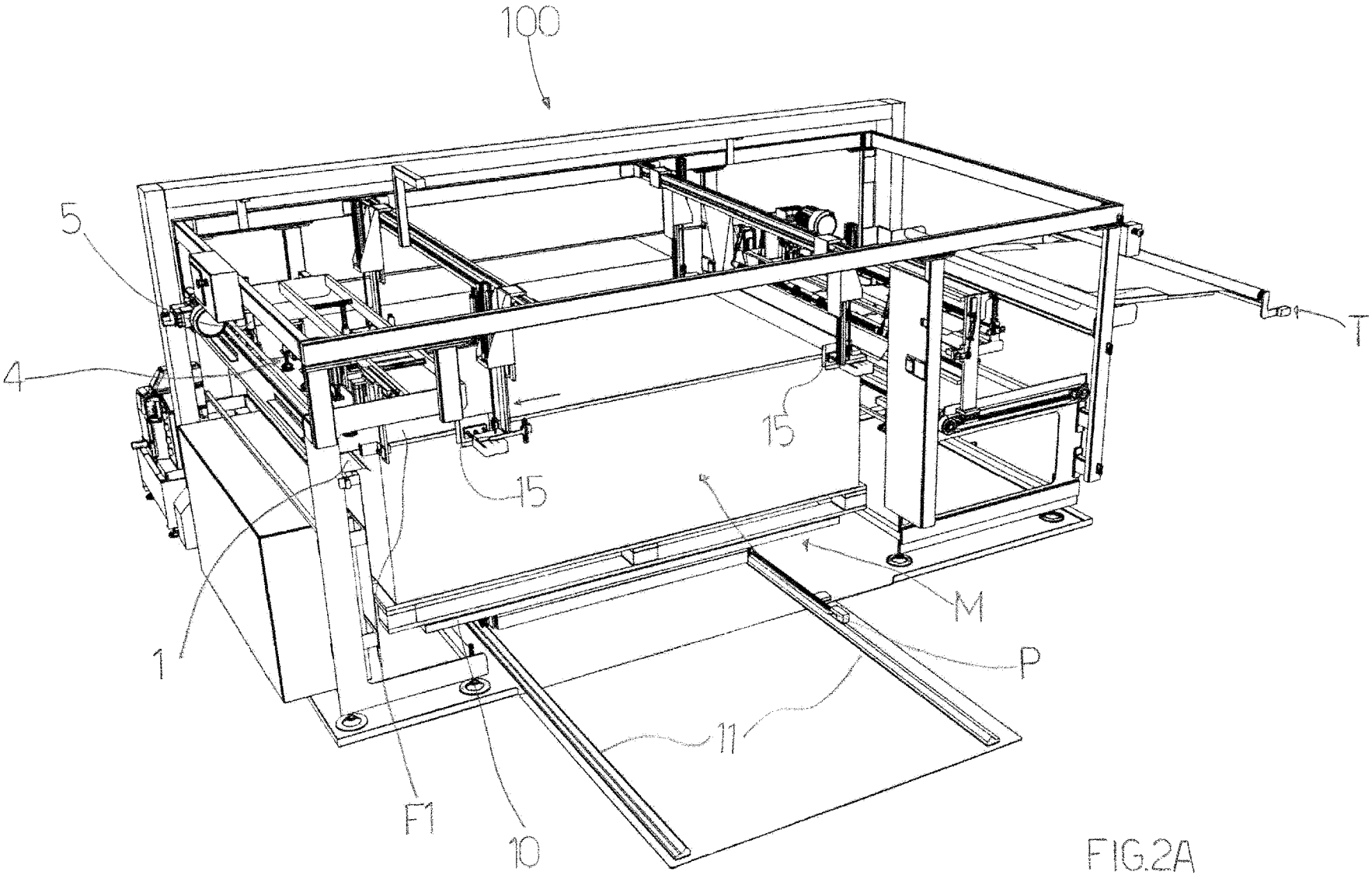
FIGS. 2A to 2D illustrate, in respective schematic perspective views, the apparatus of the invention is relative different operating steps.
Figure 2B:
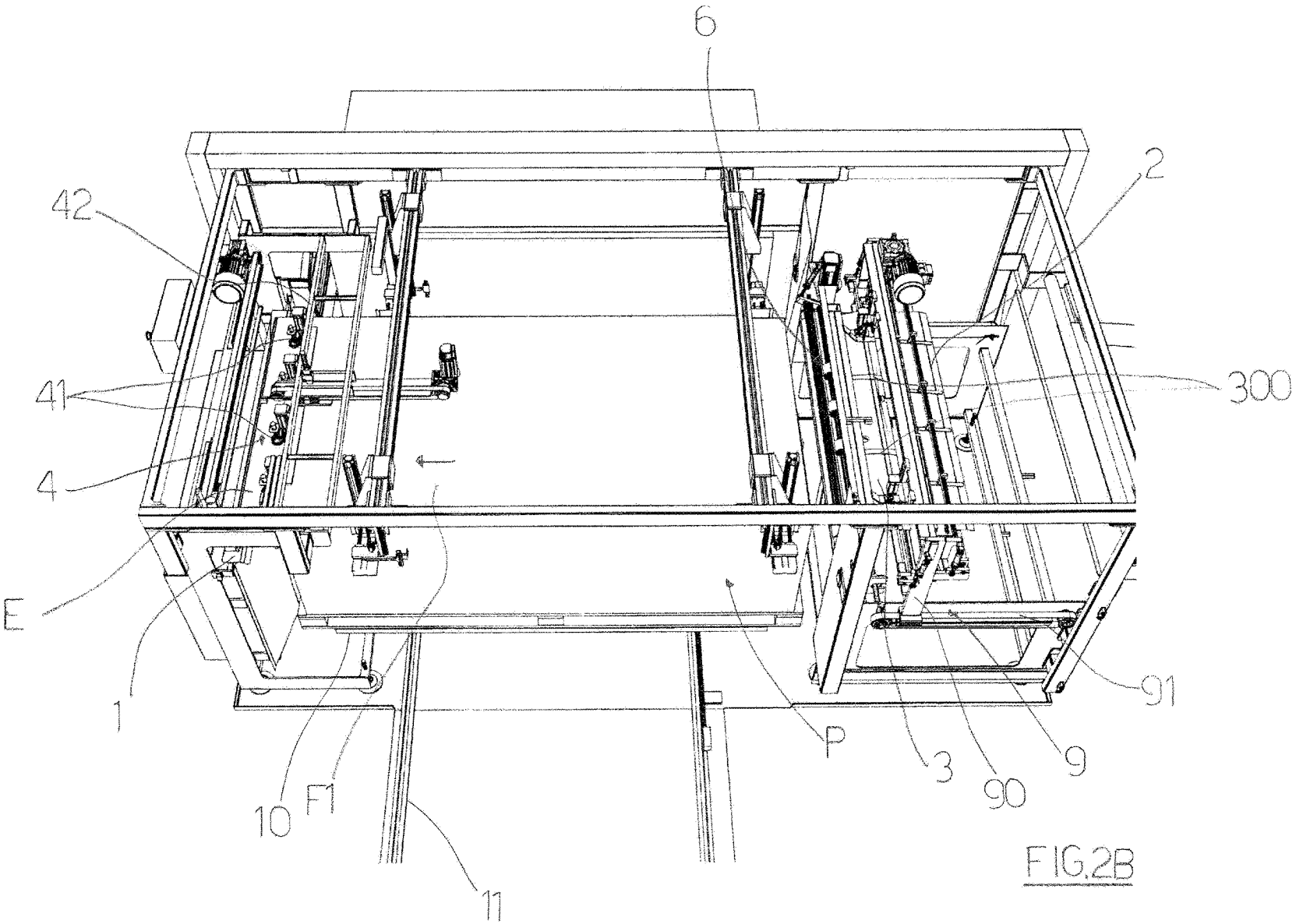
Figure 4A:
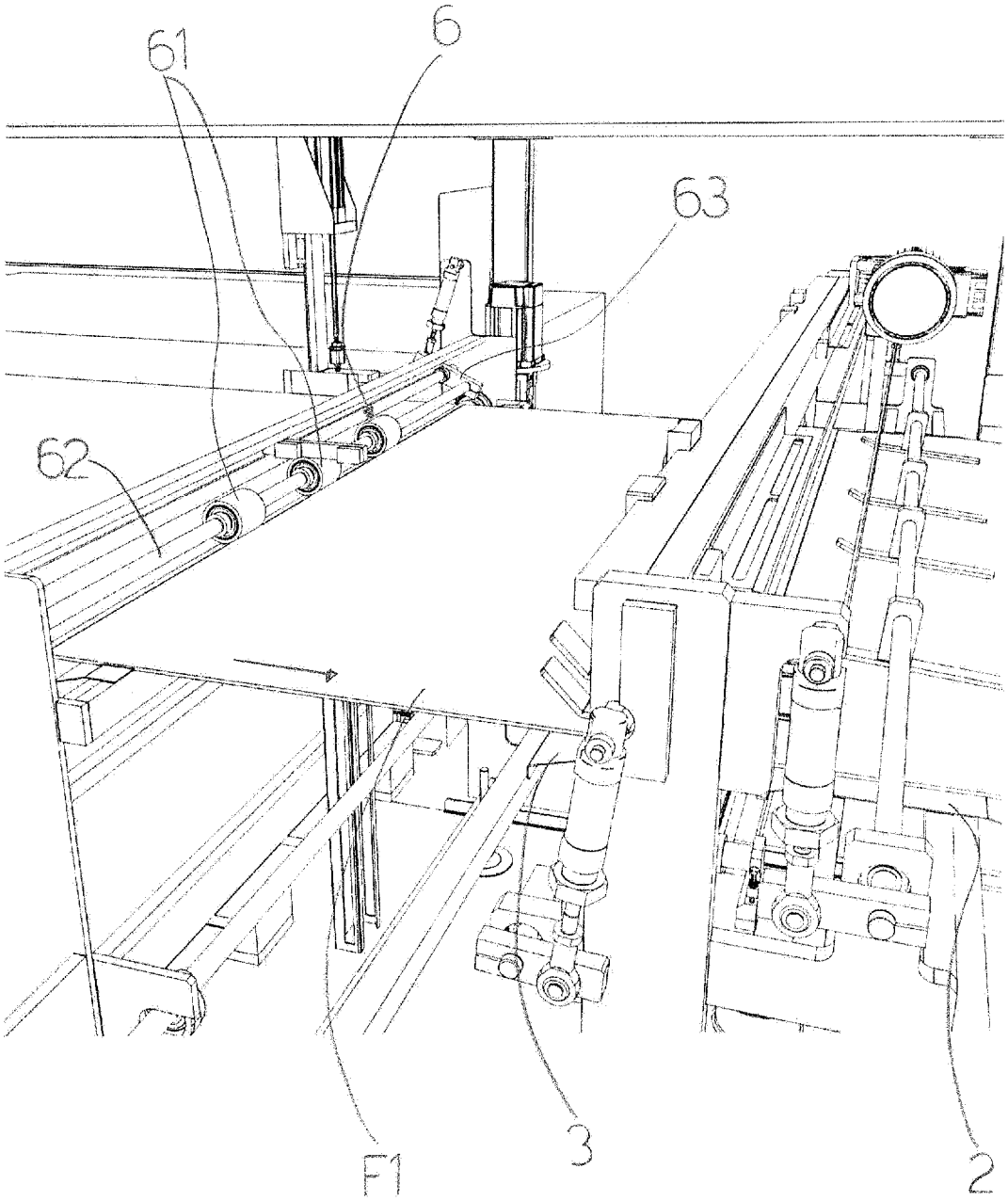
FIGS. 4A to 4F illustrate, in a larger scale and in relative schematic perspective views, an operating sequence of further components of the apparatus for superposing end parts of two cardboard sheets and for reciprocal fixing thereof.
Figure 4B:
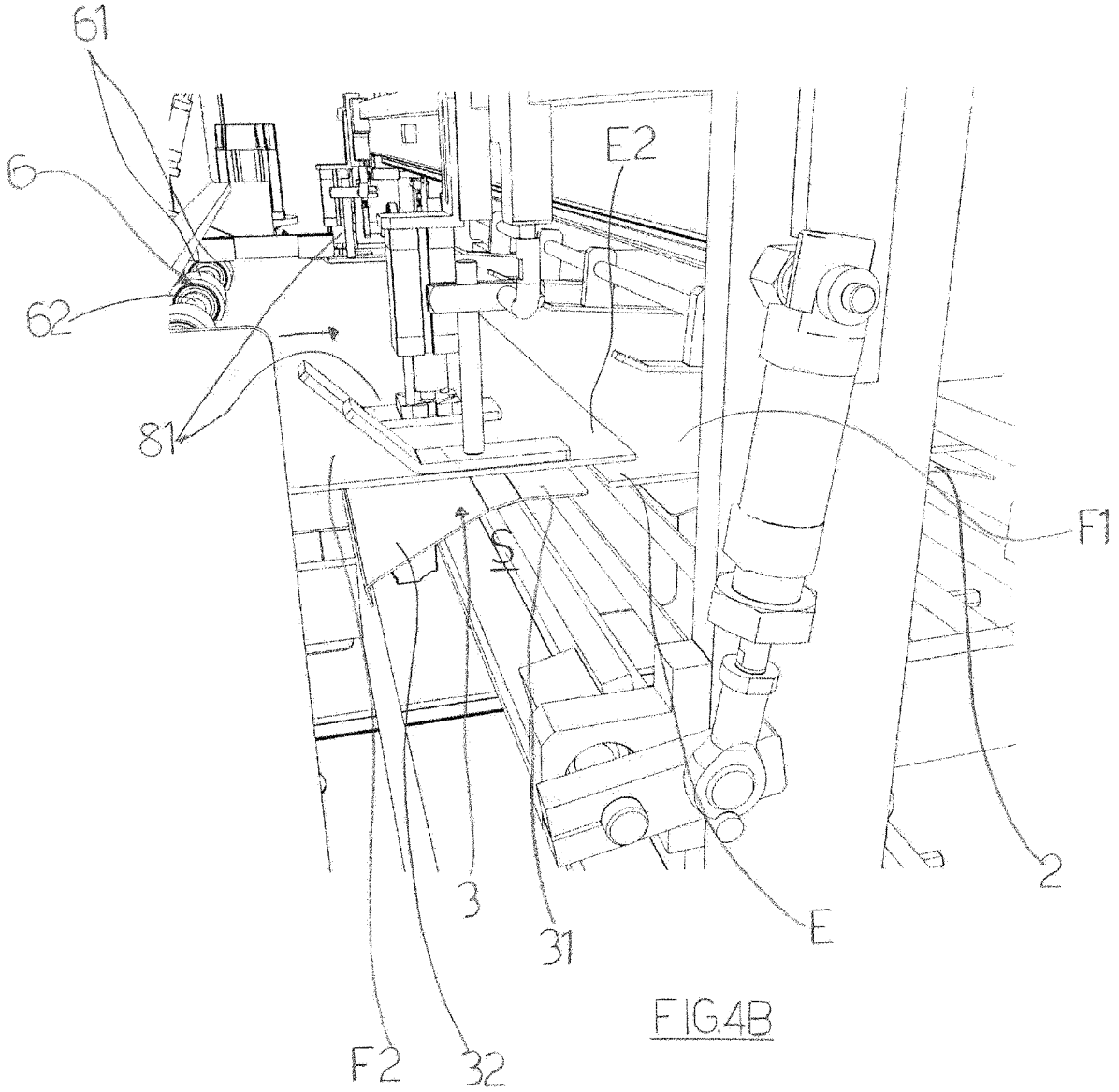

The apparatus (100) of the present invention comprises:

a store (M), predisposed and configured for receiving a plurality of cardboard sheets (C) stacked on one another to form a stack (P) of cardboard sheets (C) (see for example FIGS. 1 and 2A to 2D);

a first support (1), which is arranged at a first side of the store (M), configured and predisposed to be able to restingly receive an end portion (E) of a cardboard sheet (F1) (see for example FIG. 2A and figures from 3A to 3C);

a second support (2) arranged on a second side of the store (M), opposite the first side, so as to be on the opposite side to the first support (1) with respect to the store (M), predisposed and configured to restingly receive a cardboard sheet (F1) so that an end portion (E) of the cardboard sheet (F1) is projecting from the second support (2) and facing towards the store (M) (see for example FIG. 4B);

a third support (3), which is arranged between the second support (2) and the store (M), and movable between a first raised configuration (S), in which a part (31) of the third support (3) is raised with respect to the second support (2), and a second lowered configuration (A) in which the part (31) of the third support (3) is lowered with respect to the second support (2) (the purpose of these two configurations for the third support will be described in detail in the following).

Figure 3A:
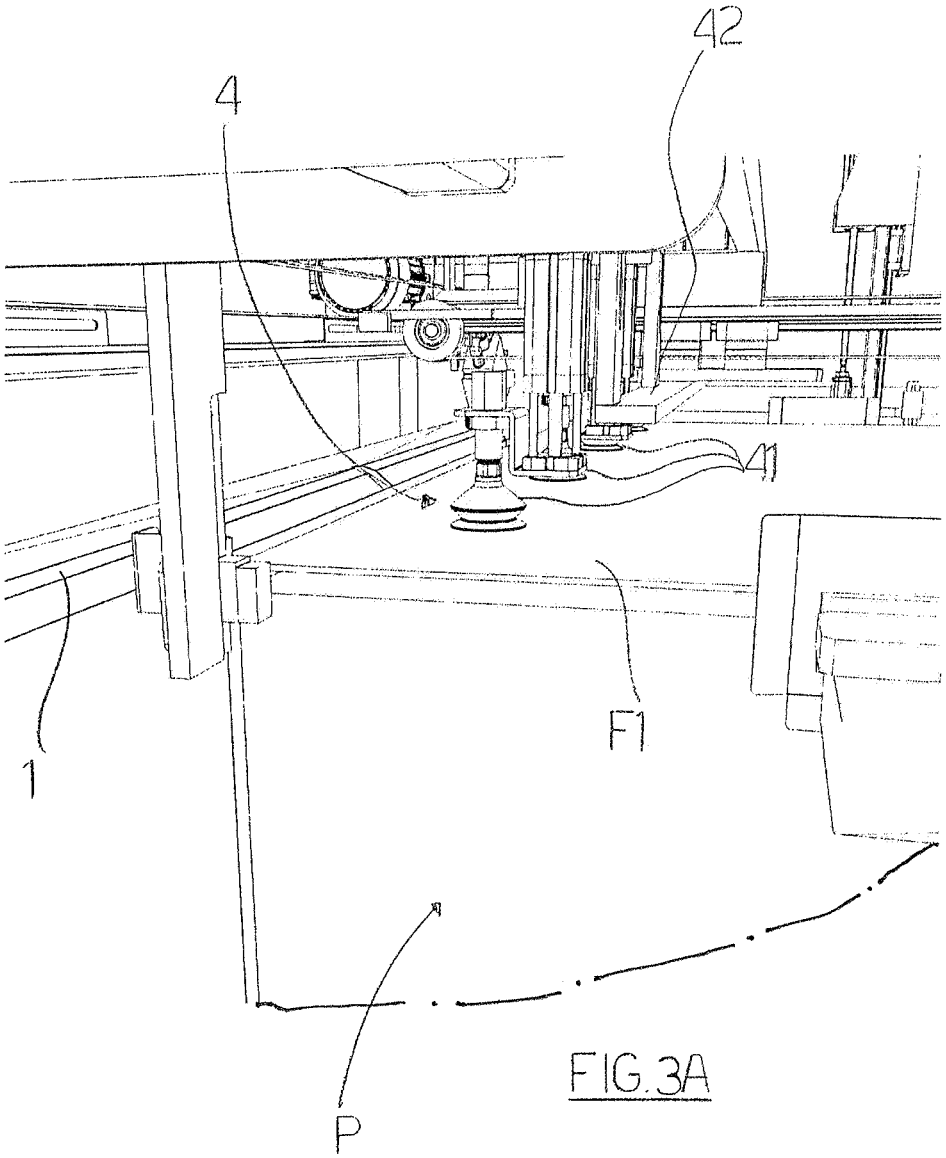
FIGS. 3A to 3C illustrate, in a larger scale and in relative schematic perspective views, an operating sequence of some significant components of the apparatus for application of adhesive material on an end portion of a cardboard sheet.
Figure 3B:
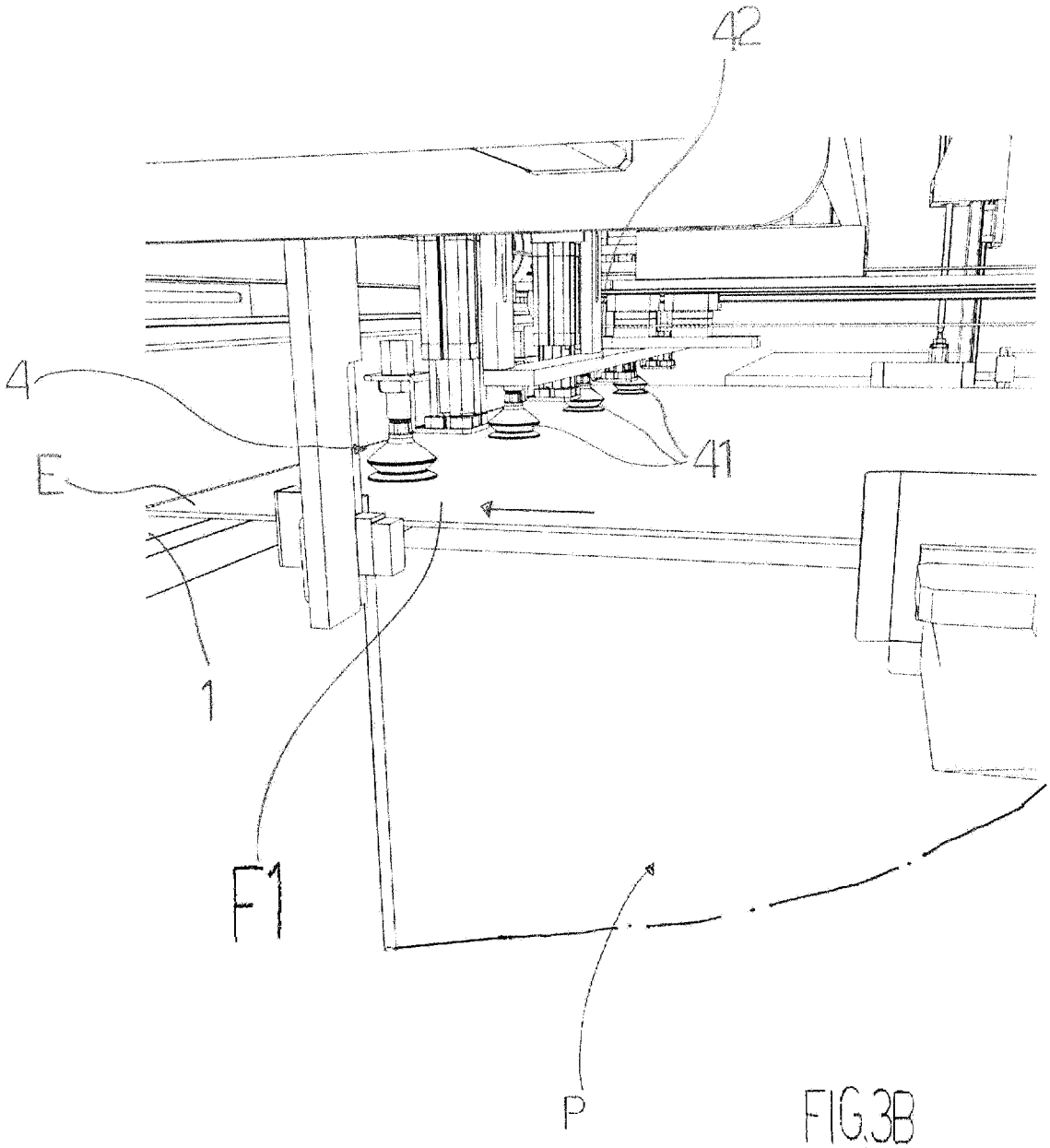
Figure 3C:
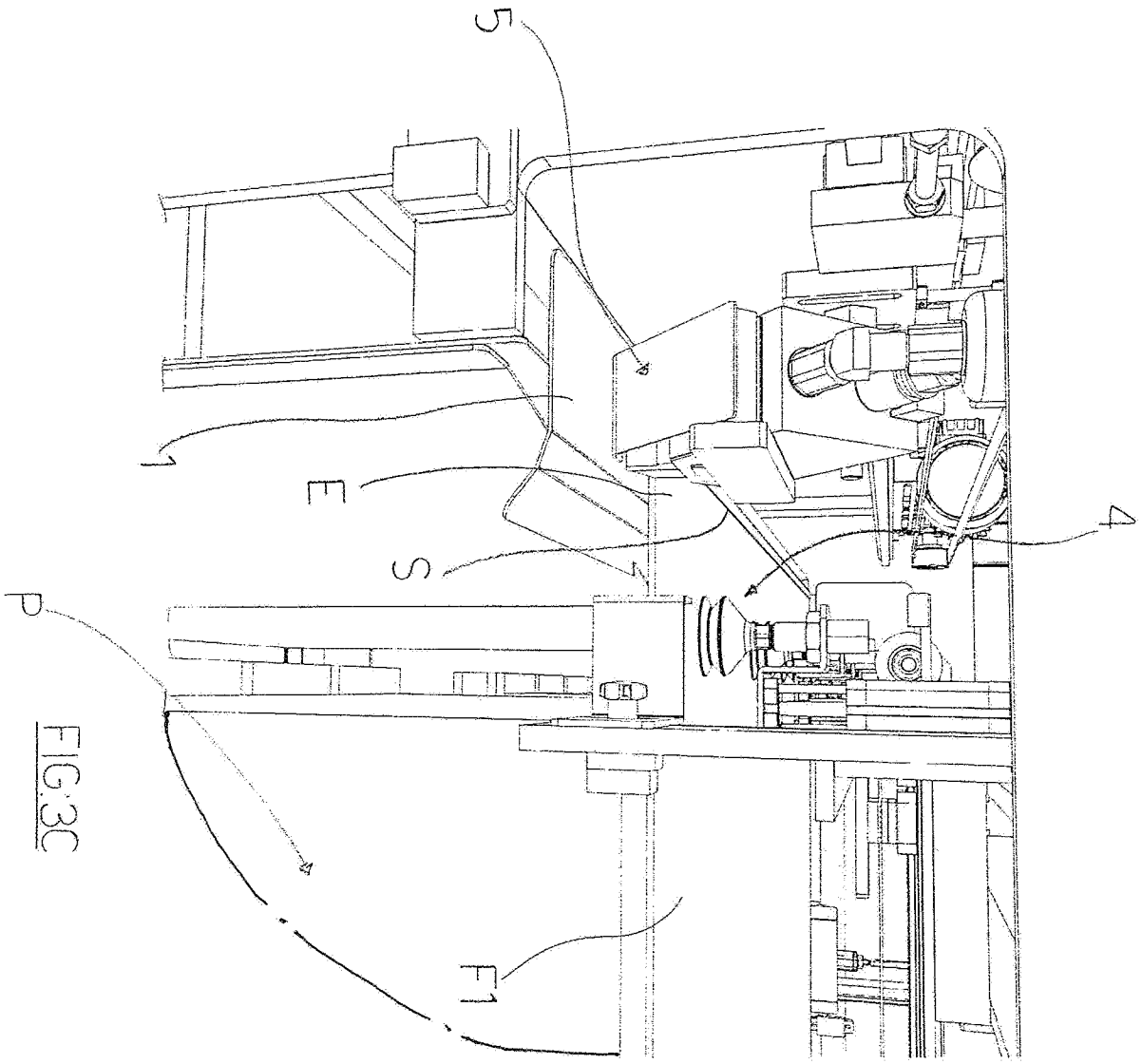

The apparatus (100) further comprises:

gripping means (4), which are predisposed and configured to pick up a first cardboard sheet (F1) from the top of the stack (P) of cardboard sheets present in the store (M) and to transfer to and position the first cardboard sheet (F1) at the first support (1) so that an end portion (E) of the first cardboard sheet (F1) is resting on the first support (1) (see FIG. 2A and figures from 3A to 3C);

application means (5) of an adhesive material, which are predisposed and configured to apply adhesive material, for example a strip (S) of adhesive material, on the upper face of the end portion (E) of the first cardboard sheet (F1) rested on the first support (1) (see for example FIG. 3C);

transfer means (6), which are predisposed and configured to transfer the first cardboard sheet (F1), on which the adhesive material has been applied, from the store (M) towards the second support (2), so that the first cardboard sheet (F1) is rested on the second support (2) with the relative end portion (E) on which the adhesive material has been applied remaining projecting and facing towards the store (M) (see for example FIGS. 2C and 2D, and FIGS. 4A and 4B), and pressor means (7), which are predisposed and configured so as to be activatable between the second support (2) and the third support (3).

Figure 4C:
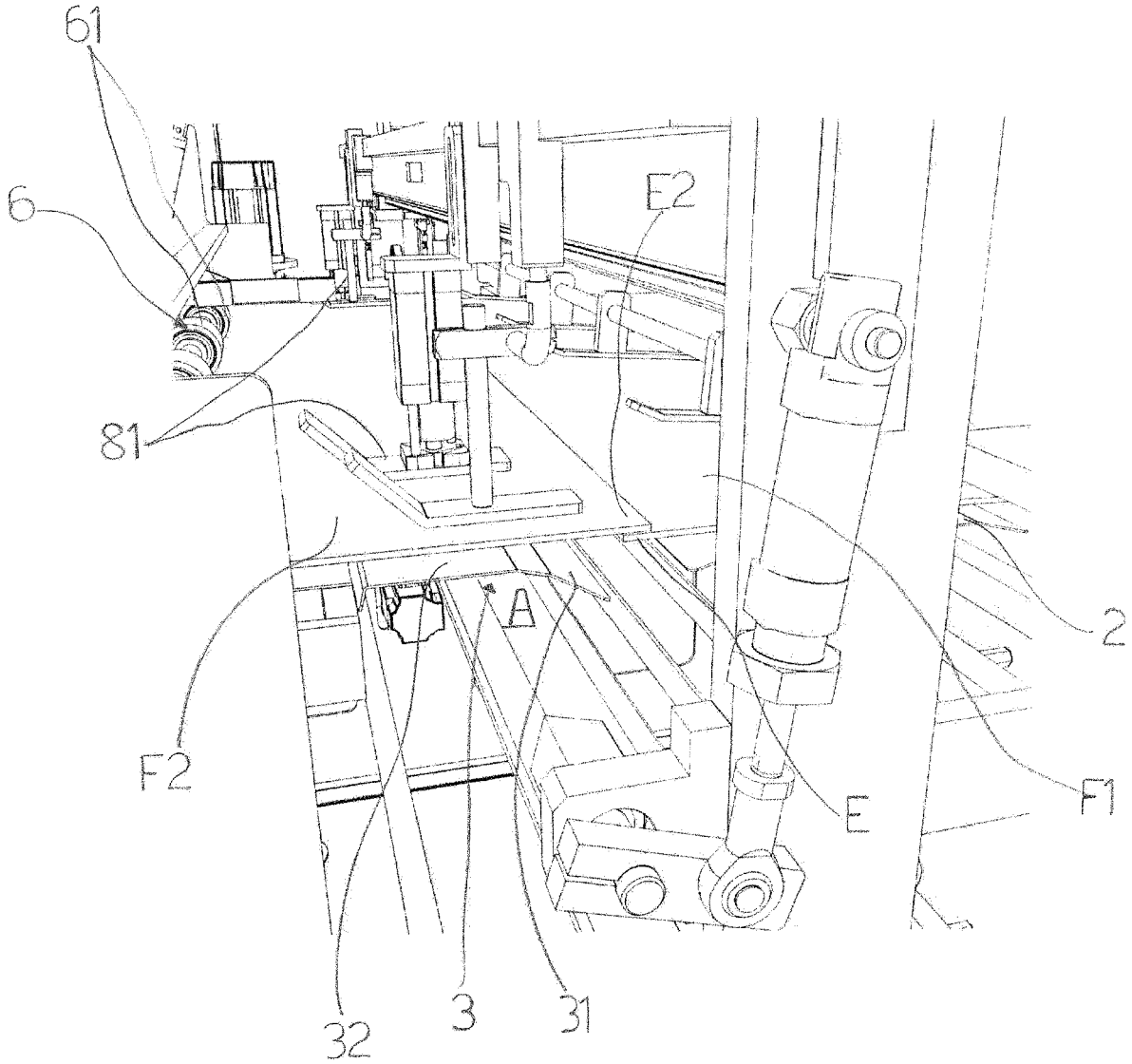

In particular, the apparatus (100) is such that:

the third support (3) is activatable in order to be positioned in the first raised configuration (S), so as to switch and raise an end portion (E2) of a second cardboard sheet (F2) which is transferred from the store (M) towards the second support (2) by the transfer means (6), so that the end portion (E2) of the second sheet (F2) which is raised is positioned above the end portion (E) of the first cardboard sheet (F1) on which the adhesive material has been applied and is projecting from the second support (2) (see in particular FIG. 4B), the third support (3) is then activatable so as to be positioned in the second lowered configuration (A) so as to lower the second end portion (E2) of the second sheet (F2) and position it at the end portion of the first sheet (F1) on which the adhesive material has been applied so that the two end portions (E, E2) are in contact with one another (see in particular FIG. 4C).

Figure 4D:
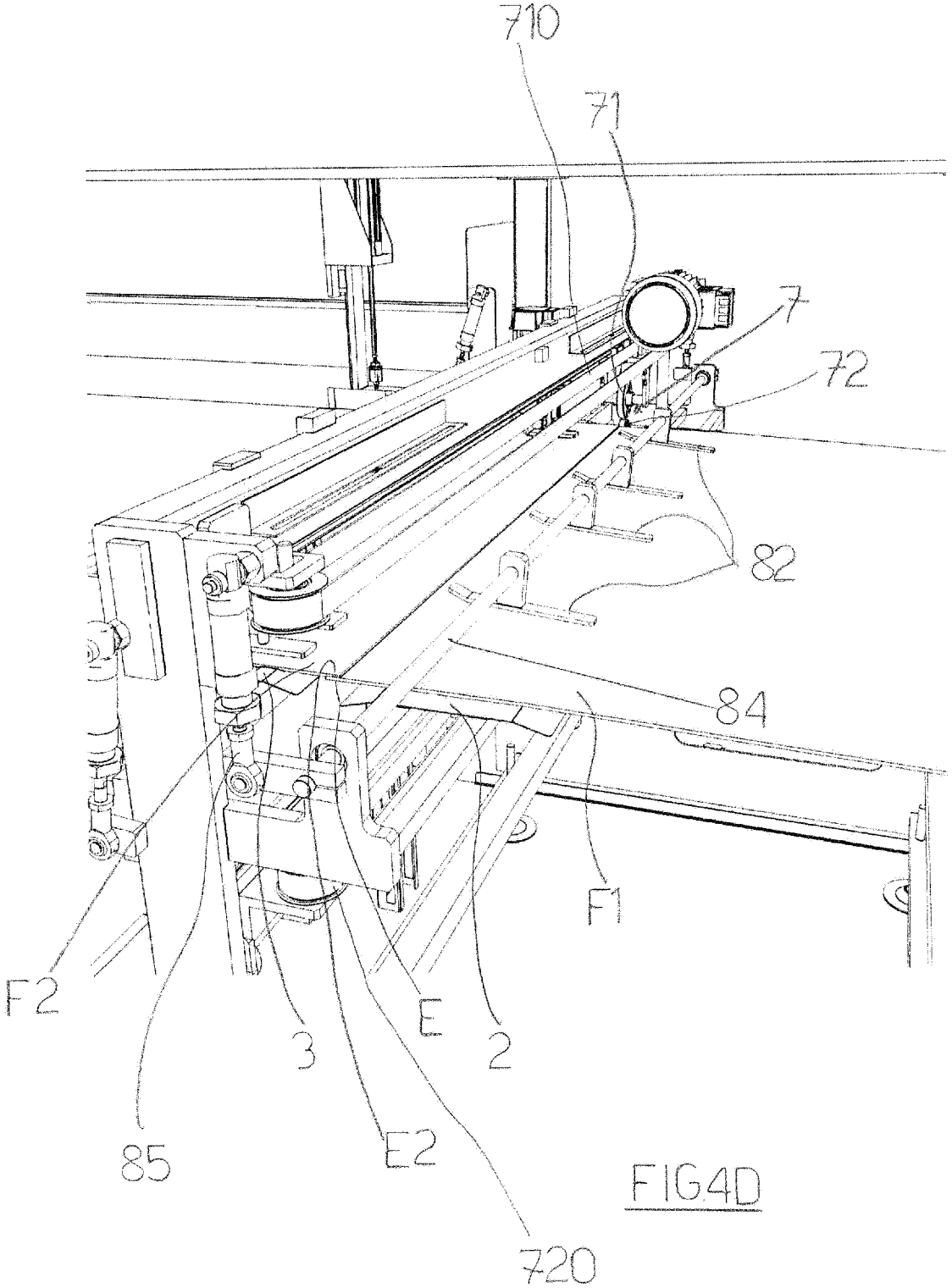
Figure 4E:
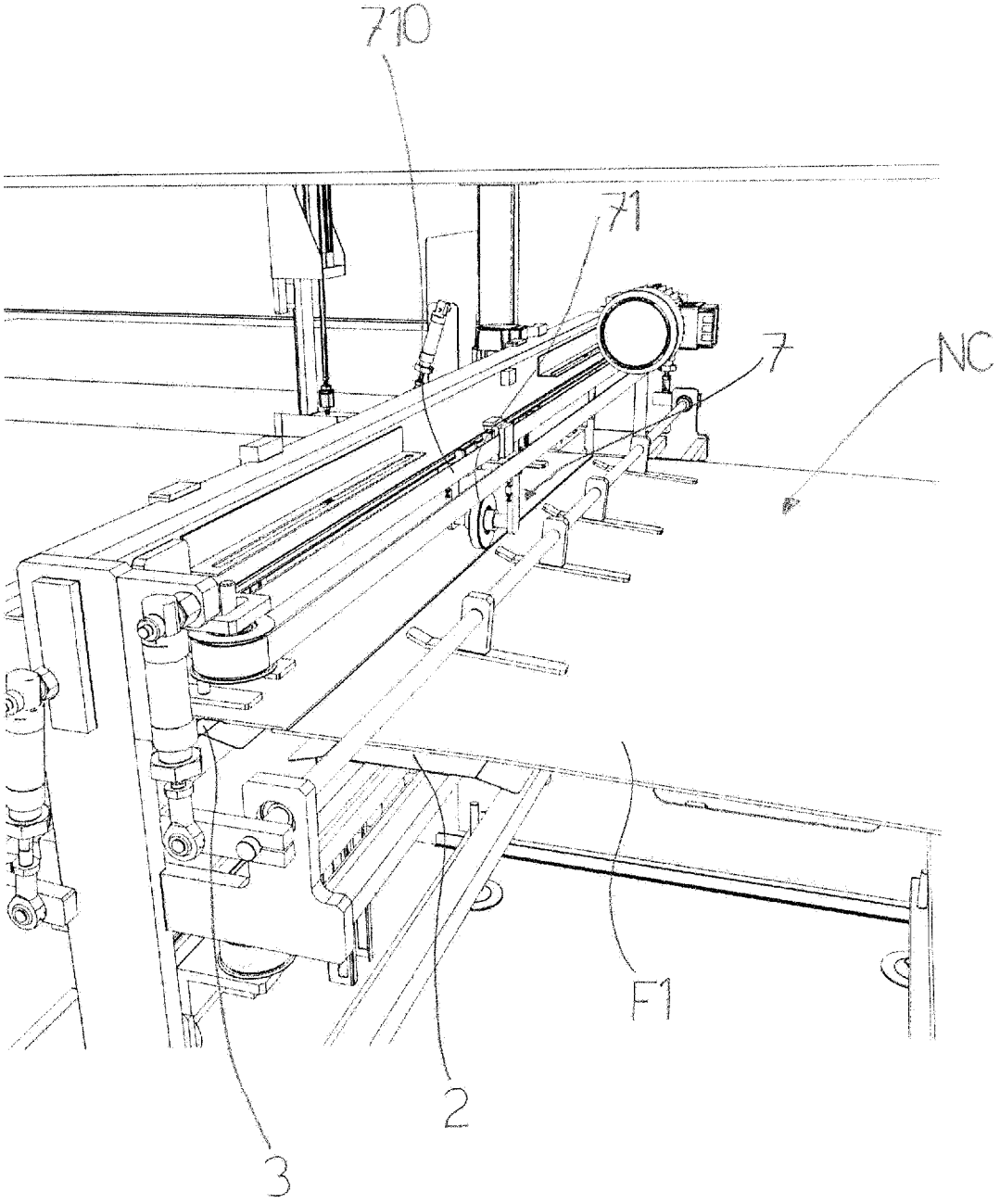

Lastly, the apparatus (100) is such that the pressor means (7), once the third support (3) has been positioned in the second lowered configuration (A) and the end portion (E2) of the second sheet (F2) has been superposed and positioned on the end portion (E) of the first sheet (F1) projecting from the second support (2) (FIG. 4D), are activated transversally to the two sheets (F1, F2), between the second support (2) and the third support (3), so as to press the two superposed end portions (E, E2) of the two sheets (F1, F2) to one another in order to fix the end portions (E, E2) to one another to form a cardboard strip (NC) (see FIG. 4E).

Figure 4F:
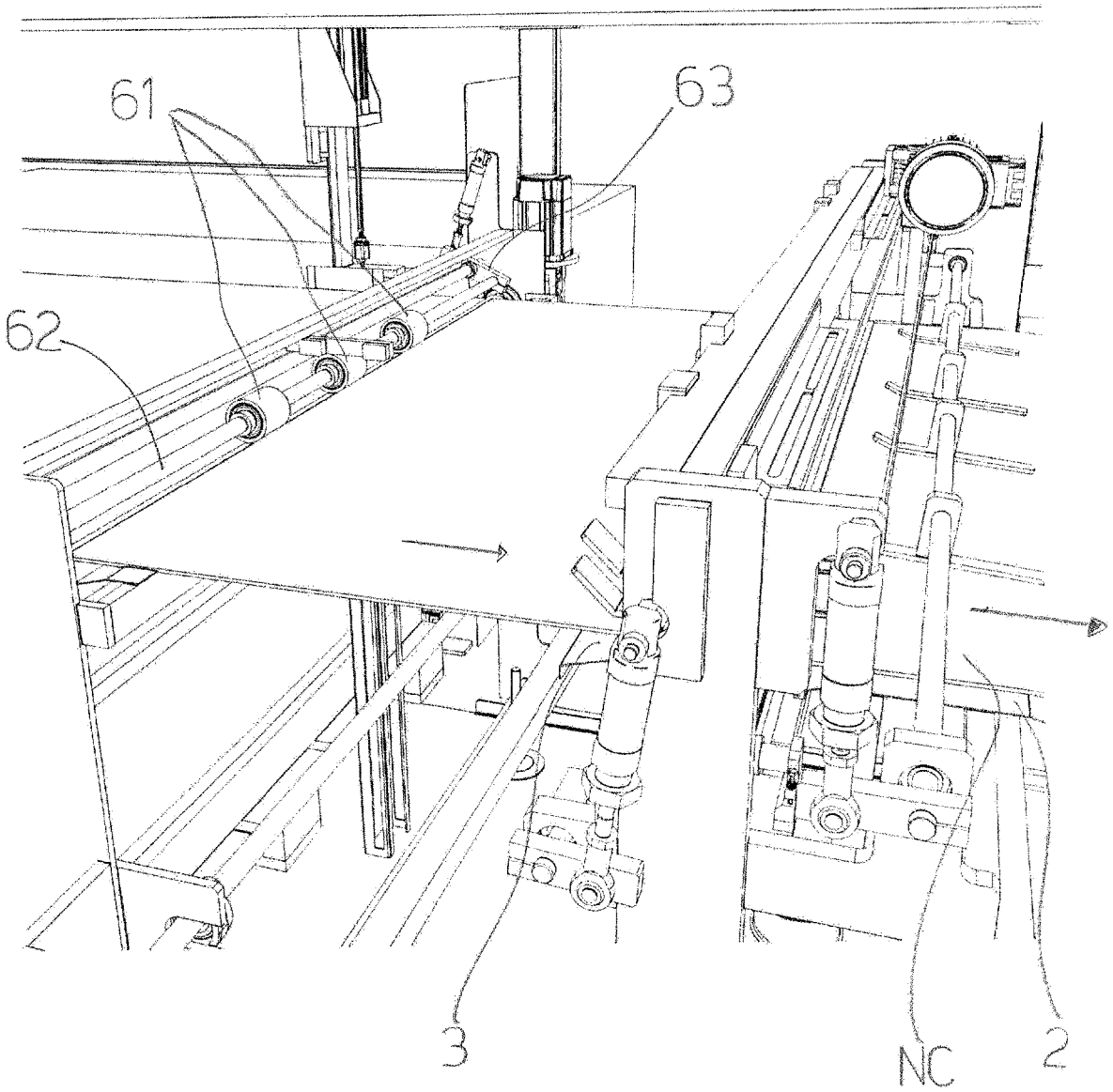

Owing to the combination of the special characteristics described in the foregoing, with the apparatus of the invention it is possible to obtain a cardboard strip which can be made available for a packaging machine, and thus the packaging machine can pull the cardboard strip (FIG. 4F) to carry out the packaging operations thereof.

The special arrangement of the first support element (1), on which is placed an end portion of a cardboard sheet for application of the adhesive material, from a first side of the store (M), and the arrangement of the second (2) and third support (3), between which the joining and fixing between the two cardboard sheets takes place, on a second side, opposite the first side, of the store (M), makes the operations of realising the cardboard strip rapid and effective, as the cardboard sheets which are to be picked up from the stack of cardboard sheets present in the store are moved in a straight manner.

Other advantageous characteristics of the apparatus of the invention are described in the following.

Figure 2C:
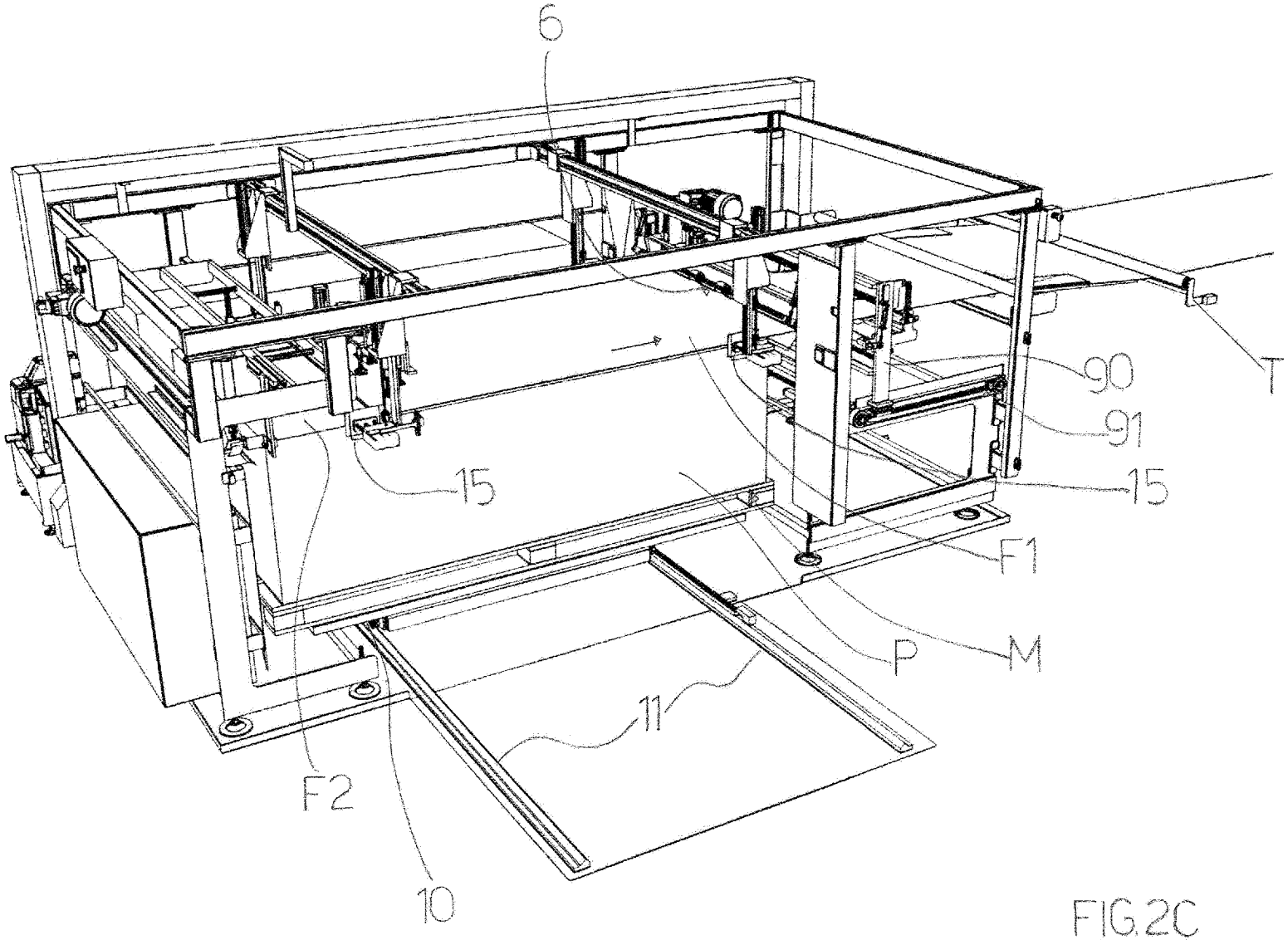
Figure 2D:
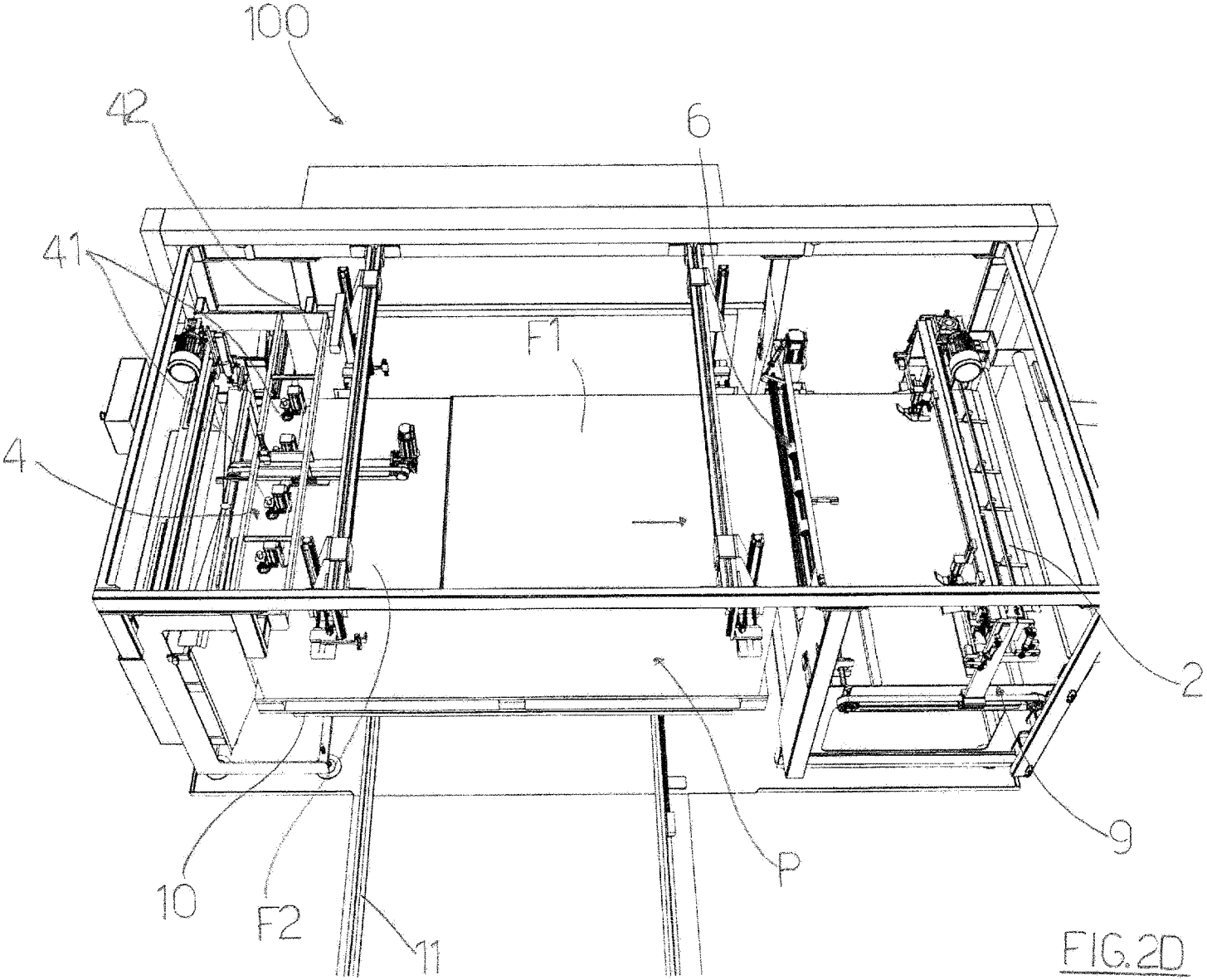

The apparatus (100) is such that the gripping means (4) are configured, when the transfer means (6) have transferred the first cardboard sheet (F1) towards the second support (2), so as to pick up the second cardboard sheet (F2) from the top of the stack (P) of cardboard sheets (C) present in the store (M) and to transfer to and position the second cardboard sheet (F2) at the first support (1) so that a first end portion of the second cardboard sheet (F2) is resting on the first support (1) (a situation alike that illustrated for the first sheet in FIGS. 2C and 2D).

Further, the apparatus (100) is such that, once the adhesive material has been applied on the first end portion of the second sheet (F2) by the application means (5) of adhesive material, the transfer means (6) are configured so as to transfer the second cardboard sheet (F2) towards the second support (2) so that a second end portion (E2) of the second cardboard sheet (F2), opposite the first end portion on which the adhesive material has been applied, can be first raised, by the third support (3) positioned in the first raised configuration (S), and then positioned, following the positioning of the third support (3) in the second lowered configuration (A), above and in contact with the portion (E) of the first cardboard sheet (F1) projecting from the second support (2).

Thus, in order to obtain a continuous cardboard strip by joining two cardboard sheets at a time in succession, the apparatus (100) is such that: the gripping means (4), are configured to be cyclically activatable to pick up successive single cardboard sheets from the top of the stack (P) of cardboard sheets (F) present in the store (M) and to cyclically transfer to and position the successive single cardboard sheets at the first support (1) so that a first end portion (E) of the successive single cardboard sheets is resting on the first support (1) and the application means (5) of adhesive material apply the adhesive material on the upper surface of the first end portion;

the transfer means (6) are configured and predisposed to cyclically transfer the successive single cardboard sheets, on which the adhesive material has been applied, towards the second support (2) and wherein the third support (3) is cyclically activatable so as to be first positioned in the first raised configuration (S) so as to switch and raise a second end portion of the successive single sheets, opposite the first portion on which the adhesive material has been applied, so that the second end portion of the successive single sheets is positioned above the end portion of a preceding single sheet resting on the second support (2), on which end portion the adhesive material had been applied, and is then activatable so as to be positioned in the second lowered configuration (A) so as to lower the second end portion of the successive single sheets positioning the second end portion at the end portion of the preceding single sheet on which the adhesive material is applied so that the two end portions are in contact with one another, and the pressor means (7), once the third support (3) has been positioned in the second lowered configuration (A) and the second end portion of the successive sheets has been superposed and positioned on the end portion of the preceding sheet, are cyclically activatable in such a way as to press the two end portions of the two sheets to one another and form a continuous cardboard strip (NC).

In order advantageously to make the transfer operations of the sheets towards the second support (2) more rapid, i.e. towards the zone in which the sheets have to be joined together, once the adhesive material has been applied thereon, the gripping means (4) are configured to pick up by suction a cardboard sheet from the top of the stack (P) of cardboard sheets (C) present in the store (M) and transfer the cardboard sheet towards the first support (1) so that an end portion of the cardboard sheet is resting on the first support (1), and are configured, once the application means (5) of the adhesive material have applied adhesive material on the upper surface of the end portion of the cardboard sheet rested on the first support (1), so as to transfer the cardboard sheet in the direction of the second support (2), by sliding the cardboard sheet on the stack (P) of cardboard sheets (C), and then release the cardboard sheet to enable the transfer means (6) to further transfer the cardboard sheet towards the second support (2).

In a preferred embodiment illustrated in the figures, the gripping means (4) comprise a series of suction gripping elements (41) borne, vertically movable, by a first frame (42) activatable in translation above the stack of sheets (P) present in the store (M), towards the first support (1) and towards the second support (2).

In turn, and still based on the preferred embodiment illustrated, the transfer means (6) comprise rollers (61) mounted on a shaft (62) activatable in rotation by a relative motor, the shaft (62) is borne by a second frame (63) movable vertically so as to be able to lower the rollers (61) in such a way that the rollers (61) can abut the cardboard sheet on which the adhesive material has been applied and, when activated in rotation by the rotation of the shaft (62), can transfer the cardboard sheet towards the second support (2).

The second frame (63) is further movable vertically so as to be able to lower the rollers (61) in connection with the passage of the portion of the cardboard sheet on which the adhesive material has been applied in such a way that the rollers (61) do not touch the adhesive material.

In particular, the second frame (63) is predisposed between the third support (3) and the store (M).

The apparatus (100) further comprises a support structure (9), the second support (2), the third support (3) and the pressor means (7) being borne by the support structure (9).

The support structure (9) is predisposed and configured so as to be translatable in a nearing or distancing motion to and from the store (M) so that the distance of the third support (3), the second support (2) and the pressor means (7) from the store (M) can be varied and regulated as a function of the position of the end portion of the last cardboard sheet of the cardboard strip, when the cardboard strip being formed is pulled by a pulling device (T) present in a packaging machine arranged downstream of the support structure (9) (schematically illustrated, for example, in FIGS. 2A and 2C), so that the second support (2) can be displaced in such a way as to support the last sheet of the cardboard strip with the relative end portion projecting from the second support (2) and facing towards the third support (3).

For example, the support structure (9) can be formed by a portal (90) which is translated in a nearing direction to, or in a distancing direction from, the store by means of loop-wound belts (91).

A further aspect is constituted by the presence of metal straps (300) which are arranged between the store (M) and the third support (3) (visible for example in FIG. 2B): the function of these metal straps (300) is to provide a support for the cardboard sheet which is transferred from the store (M) towards the second support (2).

The metal straps (300) are configured and predisposed to lengthen or retract in consequence of the movement of the support structure (9), away from or towards the store (M)

For example, a first end of the metal straps (300) can be connected to the third support (3) and the other end to a counter-weight.

The pressor means (7) are conformed so as to comprise two counter-rollers (71, 72), a first counter-roller (71) superiorly and transferably movable at the two superposed end portions of the two sheets, and a second counter-roller (72), opposite the first counter-roller, inferiorly and transferably movable at the two superposed end portions of the two sheets.

For example, as illustrated in FIGS. 4D and 4E, the two counter-rollers (71, 72) are borne by relative belts (710, 720) loop-wound and arranged transversally to the second support (2) and to the third support (3).

The function of the two counter-rollers is not only to fix the superposed portions of the sheets to one another by means of the adhesive material, which is compressed, but is also to reduce the thickness of the two superposed portions, so as to obtain a cardboard strip with a thickness that is substantially uniform, including at the joint between the various sheets which form it.

In another aspect, the third support (3) is conformed in such a way as also to comprise a second part (32), inclined with respect to the part (31) and is such that, when the third support (3) is positioned in the second lowered configuration (A), the second part (32) is arranged in such a way as to support the second successive sheet to be fixed to the preceding sheet arranged on the second support (2), the second end of the second successive sheet being arranged above and in contact with the end portion of the preceding first sheet on which the adhesive material has been applied (see for example FIGS. 4C and 4D).

The apparatus (100) further comprises first abutting means (81) which are arranged above the third support (3) so as to be movable vertically in such a way as to be able to abut the upper part of a cardboard sheet which is transferred towards the second support at the third support (3), when the third support is in the first raised configuration (S) (see FIG. 4B).

The first abutting means (81) are then lowerable in order to remain in contact with the cardboard sheet when the third support (3) is brought into the second lowered configuration (A) (see for example FIG. 4C).

The presence of the first abutting means (81) thus serves to accompany the cardboard sheet during the lowering thereof and superpose it on the preceding cardboard sheet resting on the second support (2) and, further, in order to keep the cardboard sheet laid out during the activating of the pressor means (7).

Likewise, the apparatus (100) comprises second abutting means (82) which are arranged above the second support (2) and which are movable vertically, for example by means of a relative piston, towards the cardboard sheet positioned on the second support (2), in order to keep the cardboard sheet stretched out during the activating of the pressor means (7).

The second abutting means (82) can for example be formed by a series of skate-shaped elements borne by a relative rod (84) which is connected to a piston (85) (see for example FIG. 4D).

In a further aspect, the apparatus (100) comprises a support shelf (10) for the stack (P) of cardboard sheets (C).

The support shelf (10) is advantageously vertically movable (for example by a pantograph lift) to raise the stack (P) of cardboard sheets (C) during the picking up of the sheets by the gripping means (4) so as to maintain the top of the stack being emptied at a same height.

The apparatus further comprises guide elements (11) (visible for example in figures from 2A to 2D), which are arranged transversally to the store (M), for the movement of the support shelf (10).

The presence of the guides (11) enables the positioning of the support shelf (11) which bears the stack of cardboard sheets, in the store (M) and the removal of the support shelf (11) from the store (M) once all of the cardboard sheets have been picked up, and then the positioning in the store (M) of a further support shelf with a new stack of cardboard sheets.

Lastly, the apparatus (100) comprises lateral stabilising means (15) of the cardboard sheets present in the stack (P) of cardboard sheets positioned in the store (M).

The stabilising means (15) are configured to laterally abut the stack (P) of cardboard sheets, in proximity of the top of the stack (P), so as to align the cardboard sheets with one another, and maintain them aligned while being picked up.

The invention claimed is:

1. An apparatus for realizing a cardboard strip for packaging by consecutively joining a plurality of cardboard sheets for packaging, comprising:

a store, for receiving a plurality of cardboard sheets stacked on one another to form a stack of cardboard sheets;

a first support, arranged at a first side of the store to restingly receive an end portion of a cardboard sheet;

a second support arranged on a second side of the store, opposite the first side and on the opposite side to the first support with respect to the store, to restingly receive a cardboard sheet with an end portion of the cardboard sheet projecting from the second support and facing towards the store;

a third support, arranged between the second support and the store, and movable between a first raised position, in which a part of the third support is raised with respect to the second support, and a second lowered position in which the part of the third support is lowered with respect to the second support;

gripping means for picking up a first cardboard sheet from the top of the stack of cardboard sheets present in the store and for transferring the first cardboard sheet to and positioning the first cardboard sheet at the first support with an end portion of the first cardboard sheet resting on the first support;

application means for applying adhesive material on the upper face of the end portion of the first cardboard sheet rested on the first support;

transfer means for transferring the first cardboard sheet, with applied adhesive material, from the store towards the second support and for resting the first cardboard sheet on the second support with the relative end portion having the adhesive material projecting and facing towards the store; and pressor means, predisposed and activatable between the second support and the third support, wherein the third support is positionable in the first raised position, to switch and raise an end portion of a second cardboard sheet which is transferred from the store towards the second support by the transfer means, to position the end portion of the second sheet which is raised above the end portion of the first cardboard sheet having the adhesive material and is projecting from the second support, and wherein the third support is then positionable in the second lowered position to lower the end portion of the second sheet and to position the end portion of the second sheet at the end portion of the first sheet bearing the adhesive material with the two end portions in contact with one another, and wherein the pressor means, once the third support has been positioned in the second lowered position and the end portion of the second sheet has been superposed and positioned on the end portion of the first sheet projecting from the second support, are activatable transversally to the two sheets, between the second support and the third support, to press the two superposed end portions of the two sheets to one another to fix the end portions to one another to form a cardboard strip.

2. The apparatus of claim 1, wherein the gripping means include means, when the transfer means have transferred the first cardboard sheet towards the second support, for picking up the second cardboard sheet from the top of the stack of cardboard sheets present in the store and for transferring the second cardboard sheet to and positioning the second cardboard sheet at the first support with a first end portion of the second cardboard sheet is resting on the first support, and wherein, once the adhesive material has been applied on the first end portion of the second sheet by the application means of adhesive material, the transfer means transfer the second cardboard sheet towards the second support whereby a second end portion of the second cardboard sheet, opposite the first end portion with the adhesive material, can be first raised, by the third support positioned in the first raised position, and then positioned, following the positioning of the third support in the second lowered position, above and in contact with the portion of the first cardboard sheet projecting from the second support.

3. The apparatus of claim 2, wherein the gripping means include means for cyclically picking up successive single cardboard sheets from the top of the stack of cardboard sheets present in the store and for cyclically transferring the successive single cardboard sheets to and positioning the successive single cardboard sheets at the first support with a first end portion of the successive single cardboard sheets resting on the first support and the application means of adhesive material applying the adhesive material on the upper surface of the first end portion;

wherein the transfer means are predisposed to cyclically transfer the successive single cardboard sheets, having the adhesive material, towards the second support and wherein the third support is cyclically activatable to be positioned in the first raised position to switch and raise a second end portion of the successive single sheets, opposite the first portion with the adhesive material, with the second end portion of the successive single sheets positioned above the end portion of a preceding single sheet resting on the second support, which end portion has the adhesive material, and is then activatable to be positioned in the second lowered position to lower the second end portion of the successive single sheets positioning the second end portion at the end portion of the preceding single sheet having the adhesive material with the two end portions in contact with one another, and wherein the pressor means, once the third support has been positioned in the second lowered position and the second end portion of the successive sheets has been superposed and positioned on the end portion of the preceding sheet, are cyclically activatable to press the two end portions of the two sheets to one another and form a continuous cardboard strip.

4. The apparatus of claim 1, wherein the gripping means pick up by suction a cardboard sheet from the top of the stack of cardboard sheets present in the store and transfer the cardboard sheet towards the first support with an end portion of the cardboard sheet resting on the first support, and, once the application means have applied adhesive material on the upper surface of the end portion of the cardboard sheet rested on the first support, transfer the cardboard sheet in the direction of the second support, by sliding the cardboard sheet on the stack of cardboard sheets, and then release the cardboard sheet to enable the transfer means to further transfer the cardboard sheet towards the second support.

5. The apparatus of claim 4, wherein the gripping means comprise a series of suction gripping elements borne, vertically movable, by a first frame activatable in translation above the stack of sheets present in the store, towards the first support and towards the second support.

6. The apparatus of claim 1, wherein the transfer means comprise rollers mounted on a shaft activatable in rotation by a motor, the shaft is borne by a second frame movable vertically to lower the rollers to abut the cardboard sheet with the adhesive material and, when activated in rotation by the rotation of the shaft, can transfer the cardboard sheet towards the second support.

7. The apparatus of claim 6, wherein the second frame is predisposed between the third support and the store.

8. The apparatus of claim 1, wherein the second support, the third support and the pressor means are borne by a support structure to translate in a nearing and distancing direction to and from the store with the distance of the third support, the second support and the pressor means from the store variable and regulatable as a function of the position of the end portion of the last cardboard sheet of the cardboard strip, when the cardboard strip being formed is pulled by a pulling device present in a packaging machine arranged downstream of the support structure, whereby the second support can be displaced to support the last sheet of the cardboard strip with the relative end portion projecting from the second support and facing towards the third support.

9. The apparatus of claim 8, further comprising metal straps arranged between the store and the third support to provide a support for the cardboard sheet which is transferred from the store towards the second support, the metal straps being adapted to lengthen or retract in consequence of the movement of the support structure, away from or towards the store.

10. The apparatus of claim 1, wherein the pressor means comprise two counter-rollers.

11. The apparatus of claim 1, wherein the third support is conformed in such a way as also to comprise a second part, inclined with respect to the part and is such that, when the third support is positioned in the second lowered position, the second part is arranged in such a way as to support the second successive sheet to be fixed to the preceding sheet arranged on the second support, the second end of the second successive sheet being arranged above and in contact with the end portion of the preceding first sheet with the adhesive material.

12. The apparatus of claim 1, comprising a support shelf for the stack of cardboard sheets, the support shelf being vertically movable to raise the stack of cardboard sheets during the picking up of the sheets by the gripping means to maintain the top of the stack being emptied at a same height.

13. The apparatus of claim 12, comprising guide elements, arranged transversally to the store, for guiding the movement of the support shelf, to enable the positioning of the support shelf with the stack of cardboard sheets in the store and the removal of the support shelf from the store once all of the cardboard sheets have been picked up, and then the positioning in the store of a further support shelf with a new stack of cardboard sheets.

14. The apparatus of claim 1, further comprising lateral stabilising means for laterally abutting the stack of cardboard sheets, in proximity of the top of the stack, to align the cardboard sheets with one another.

15. The apparatus of claim 1, comprising first abutting means which are arranged above the third support and movable vertically to abut the upper part of a cardboard sheet;

the first abutting means being further lowerable in order to remain in contact with the cardboard sheet when the third support is brought into the second lowered position to keep the cardboard sheet laid out during the activating of the pressor means, and comprising second abutting means which are arranged above the second support and which are movable vertically towards the cardboard sheet positioned on the second support, to keep the cardboard sheet stretched out during the activating of the pressor means.

* * * * *